US006983724B2

(12) United States Patent
Carlson

(10) Patent No.: US 6,983,724 B2
(45) Date of Patent: Jan. 10, 2006

(54) STARTING A COMPRESSION IGNITION FREE PISTON INTERNAL COMBUSTION ENGINE HAVING MULTIPLE CYLINDERS

(75) Inventor: Cliff Carlson, Fenton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 10/840,930

(22) Filed: May 7, 2004

(65) Prior Publication Data

US 2005/0247272 A1 Nov. 10, 2005

(51) Int. Cl.
*F02B 71/00* (2006.01)

(52) U.S. Cl. ..... 123/46 R

(58) Field of Classification Search ..... 123/46 R, 123/46 SC, 51 B, 46 A, 46 B, 46 E; 417/364
See application file for complete search history.

(56) References Cited

U.S. PATENT DOCUMENTS

| | | | | |
|---|---|---|---|---|
| 3,751,905 | A * | 8/1973 | McKinley et al. | 60/775 |
| 4,598,683 | A * | 7/1986 | Ohmori et al. | 123/450 |
| 5,213,067 | A | 5/1993 | Kramer | |
| 5,287,827 | A * | 2/1994 | Almendinger et al. | 123/46 R |
| 5,829,393 | A | 11/1998 | Achten et al. | |
| 6,105,541 | A | 8/2000 | Berlinger | |
| 6,135,069 | A | 10/2000 | Fenelon et al. | |
| 6,158,401 | A | 12/2000 | Bailey | |
| 6,170,443 | B1 | 1/2001 | Hofbauer | |
| 6,206,656 | B1 | 3/2001 | Bailey et al. | |
| 6,279,517 | B1 | 8/2001 | Achten | |
| 6,318,309 | B1 | 11/2001 | Burrahm et al. | |
| 6,532,916 | B2 * | 3/2003 | Kerrebrock | 123/46 E |
| 2003/0051682 | A1 | 3/2003 | Achten | |

FOREIGN PATENT DOCUMENTS

| | | | |
|---|---|---|---|
| DE | 1576039 B | * | 1/1977 |
| DE | 10241101 A1 | * | 3/2004 |

OTHER PUBLICATIONS

Peter A.J. Achten, SAE Technical Paper Series, 941776, A Review of Free Piston Engine Concepts, Sep. 12-14, 1994, pp. 1-12.

Goertz et al., SAE Technical Paper Series 2000-01-0996, Free Piston Engine Its Application and Optimization, Mar. 6-9, 2000, pp.1-10.

* cited by examiner

*Primary Examiner*—Henry C. Yuen
*Assistant Examiner*—Hyder Ali
(74) *Attorney, Agent, or Firm*—David B. Kelley; MacMillan, Sobanski & Todd

(57) ABSTRACT

A method for starting a free piston, internal combustion engine includes supplying an air charge to a space in a combustion cylinder, and reciprocating the piston in the cylinder so that the maximum pressure of the air charge in the space cyclically increases. Air and fuel are cyclically admitting to the cylinder to produce an air-fuel mixture, and spark ignition is used to produce cyclic combustion of the air-fuel mixture. The air-fuel ratio of the mixture is increasing when a maximum pressure in the cylinder occurs within a predetermined period following a TDC position of the piston. Spark ignition is discontinued, and cyclic compression ignition (HCCI) of the air-fuel mixture occurs.

24 Claims, 5 Drawing Sheets

STARTING A COMPRESSION IGNITION FREE PISTON INTERNAL COMBUSTION ENGINE HAVING MULTIPLE CYLINDERS

BACKGROUND OF THE INVENTION

The invention relates to starting an internal combustion engine. In particular, the invention pertains to a procedure for starting a compression ignition, free piston internal combustion engine.

A free piston internal combustion engine includes one or more reciprocating pistons located in a combustion cylinder. No crankshaft is used to connect the pistons, coordinate their reciprocation, or establish the compression ratio of a fuel-air mixture in the cylinder. Instead, each piston moves in response to forces produced by combustion of the air-fuel mixture in the combustion cylinder. Pressure produced by combustion in one cylinder can be used to compress an air-fuel charge in another cylinder. Or an actuating system can be used to compress the air-fuel mixture following the expansion stroke. The actuating system may be used also to reciprocate the pistons while starting the engine before combustion of the air-fuel mixture occurs.

Because a free piston engine has no crankshaft connecting the pistons for synchronizing the compression and expansion strokes, a control system is used to synchronize piston reciprocation, compression of the air-fuel mixture and its combustion. Piston displacement, piston velocity, pressure in the combustion chamber, compression ratio, and other engine operating parameters are monitored and controlled by an actuator system, which periodically corrects deviations from the desired coordinated piston movement.

While starting a free piston engine, the pistons are displaced by a starter-actuator system preferably using hydraulic, pneumatic, or electromagnetic actuation. Preferably, electric energy is used to actuate the piston when starting an the engine produces electric power output, and hydraulic or pneumatic energy is used to actuate the piston when the engine produces hydraulic or pneumatic output. This invention of cycling the engine while starting in order to eliminate a vacuum condition in the combustion chamber applies to a free piston diesel engine, compression ignition, spark ignition and homogeneous charge compression ignition (HCCI) combustion engines; however, it will be described with reference to HCCI engine operation. When starting the engine, the intake air has a low temperature, but a large compression ratio of the fuel-air charge in the combustion cylinder is required to produce combustion in a compression ignition engine. Therefore, using conventional engine starting techniques, a large magnitude of energy is required to produce the compression ratio required to start the engine, especially under cold starting conditions.

If the engine pistons are driven entirely by an actuator, a large magnitude of energy is required to compress a mixture of fuel and air in the combustion chamber, particularly in a compression ignition engine that requires a high compression ratio for self-ignition to occur. A technique is required to avoid the need for a large capacity energy source to start the engine, and to ensure that combustion occurs and is sustained under a wide range of ambient operating conditions.

SUMMARY OF THE INVENTION

A free piston engine to which this invention may be applied includes axially-aligned cylinders, an inner pair of mutually connected pistons, and an outer pair of mutually connected pistons. One piston of each piston pair reciprocates in a first cylinder; the other piston of each pair reciprocates in a second cylinder. Each cylinder is formed with inlet ports, through which air enters the cylinder, exhaust ports, through which exhaust gas leaves the cylinder, and a fuel port, through which fuel is admitted, usually by injection, into the cylinder. Movement of the pistons in one cylinder, caused by combustion of a fuel-air mixture there, forces the pistons in the other cylinder to compress a fuel-air mixture in the second cylinder and to cause combustion of that mixture. In this way, the piston pairs reciprocate in the cylinders in mutual opposition, one piston pair moving longitudinal in one direction while the pistons of the other pair move in the opposite direction. When combustion occurs, the direction of movement of each piston pair is reversed until the combustion occurs in the other cylinder.

When the engine stops, the pistons can be at any position in the cylinder. A free piston engine typically has no inlet valves or exhaust valves to control the flow of air and exhaust gas into and from the cylinder. Instead, a turbocharger driven by engine exhaust supplies a pressurized air charge to the cylinder through an inlet port. If the engine is stopped with a piston in the compression stroke, leakage of the air charge from the cylinder through inlet and exhaust ports and across the piston rings will occur during the shutdown period due to the pressure in the cylinder. This leakage can produce a partial vacuum in the cylinder when the piston is cycled during the next engine restart. When the engine is restarted without a sufficient volume of air in each cylinder to provide compression pressure resistance, a piston can collide with the cylinder head or with another piston in the same cylinder because of the air spring provides insufficient resistance to piston displacement.

To avoid relying on large hydraulic or pneumatic pressures in the starting actuator, a cyclic starting strategy has been developed. The pistons are reciprocated during starting with a progressively increasing displacement in order to develop a sufficient magnitude of kinetic energy in the pistons and to produce combustion of the fuel-air charge. Energy applied to the piston in each cylinder by a starting actuator and energy recovered from expansion of the compressed charge in the other cylinder before combustion occurs combine to increase the kinetic energy of the reciprocating pistons and steadily to increase pressure in the combustion chamber.

The method for starting the engine uses an actuator, such as a hydraulic or pneumatic pump-motor or an electric linear alternator-starter to move the pistons to a position where the inlet ports are opened. This ensures that air is present in the cylinder in a space where fuel will be admitted and combustion will occur. That air space operates as an air spring during the starting procedure to store kinetic energy from the piston by compressing the air charge during the compression stroke and applying force to the pistons during the expansion stroke. The pistons reciprocate in response to the application of force acting against the air spring. The force is a periodic, preferably having a frequency that is the same or nearly the same as the natural frequency of the system that includes the inertia of the pistons and other masses reciprocating with the pistons, and the air spring, the compressible air spring in the combustion chamber. When cylinder pressure or piston displacement reaches a sufficient magnitude, air and fuel are cyclically admitted to the cylinder, and spark ignition is used to produce cyclic combustion of the air-fuel mixture. The air-fuel ratio of the mixture is reduced when a maximum pressure in the cylinder occurs within a predetermined period following a TDC position of the piston. Then spark or glow plug ignition is discontinued (if it was required), and cyclic combustion ignition of the air-fuel mixture occurs. After a sufficient number of engine combustion cycles are completed to create proper conditions for compression ignition HCCI to be established, the engine throttle is fully opened to allow maximum airflow, and fuel delivery is reduced to continue operating with HCCI combustion only.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
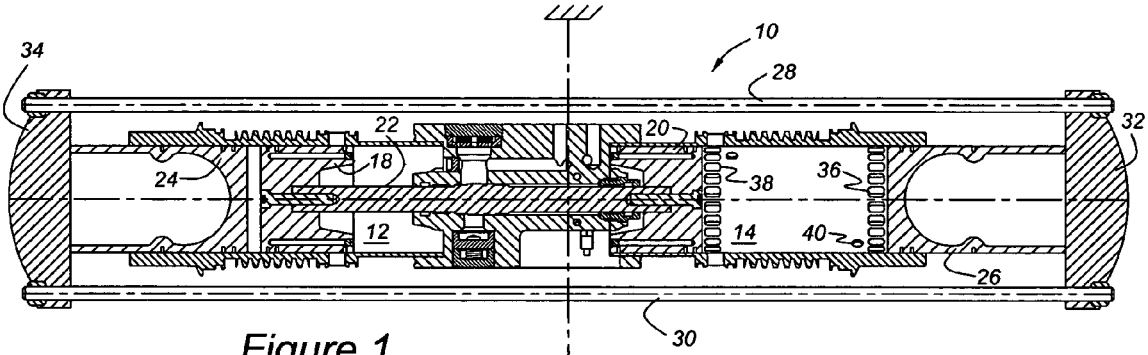
FIGS. 1 and 2 are cross sectional views taken at a longitudinal plane through a free piston engine showing schematically the position of piston pairs and combustion cylinders at opposite ends of their displacement.
Figure 2:
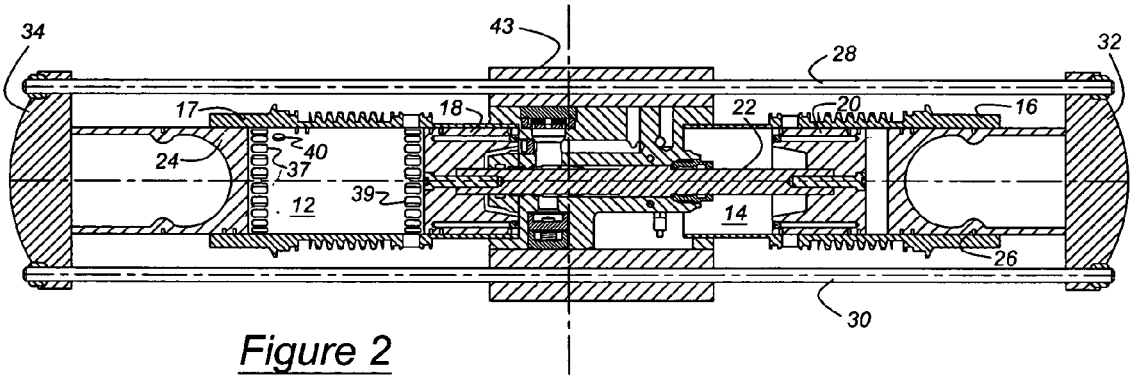

Referring first to FIGS. 1 and 2, a free piston engine 10 includes a first cylinder 12 and a second cylinder 14, axially aligned with the first cylinder, the cylinders being located in cylinder liners 16, 17, surrounded by an engine block. A first pair of pistons, inner pistons 18, 20, are mutually connected by a push rod 22. A first piston 18 of the first piston pair reciprocates within the first cylinder 12, and the second piston 20 of the first piston pair reciprocates within the second cylinder 14. A second pair of pistons, outer piston 22, 24, are connected mutually by pull rods 28, 30, and secured mutually at the axial ends of pistons 24, 26 by bridges 32, 34. A first piston of the second or outer piston pair reciprocates within the first cylinder 12, and a second piston 26 of the outer piston pair reciprocates within the first cylinder 14. Each cylinder 12, 14 is formed with air inlet ports 36, 37 and exhaust ports 38, 39. In FIG. 1, the ports 37, 39 of cylinder 12 are closed by pistons 18, 24, which are shown located near their top dead center (TDC) position, and the ports 36, 38 of cylinder 14 are opened by pistons 18, 24, which are shown located near their bottom center (BDC) position. In FIG. 2, ports 36, 38 of cylinder 14 are closed by pistons 20, 26, which are shown there located near their TDC position, and the ports 37, 39 of cylinder 12 are opened by pistons 18, 24, which are shown there located near their BDC position. When the pistons of either cylinder are at the TDC position, the pistons of the other cylinder are at or near their BDC position. Each cylinder is formed with a fuel port 40, through which fuel is admitted, preferably by injection, into the cylinder during the compression stroke.

Displacement of the piston pairs between their respective TDC and BDC positions, the extremities of travel shown in FIGS. 1 and 2, is coordinated such that a fuel-air mixture located in the space between pistons 18, 24 in cylinder 12 and between pistons 20, 26 in cylinder 14 is compressed. Combustion of those mixtures occurs within the cylinders, preferably when the pistons have moved slightly past the TDC position toward the BDC position. This synchronized reciprocation of the piston pairs is referred to as "opposed piston-opposed cylinder" (OPOC) reciprocation.

Figure 3:
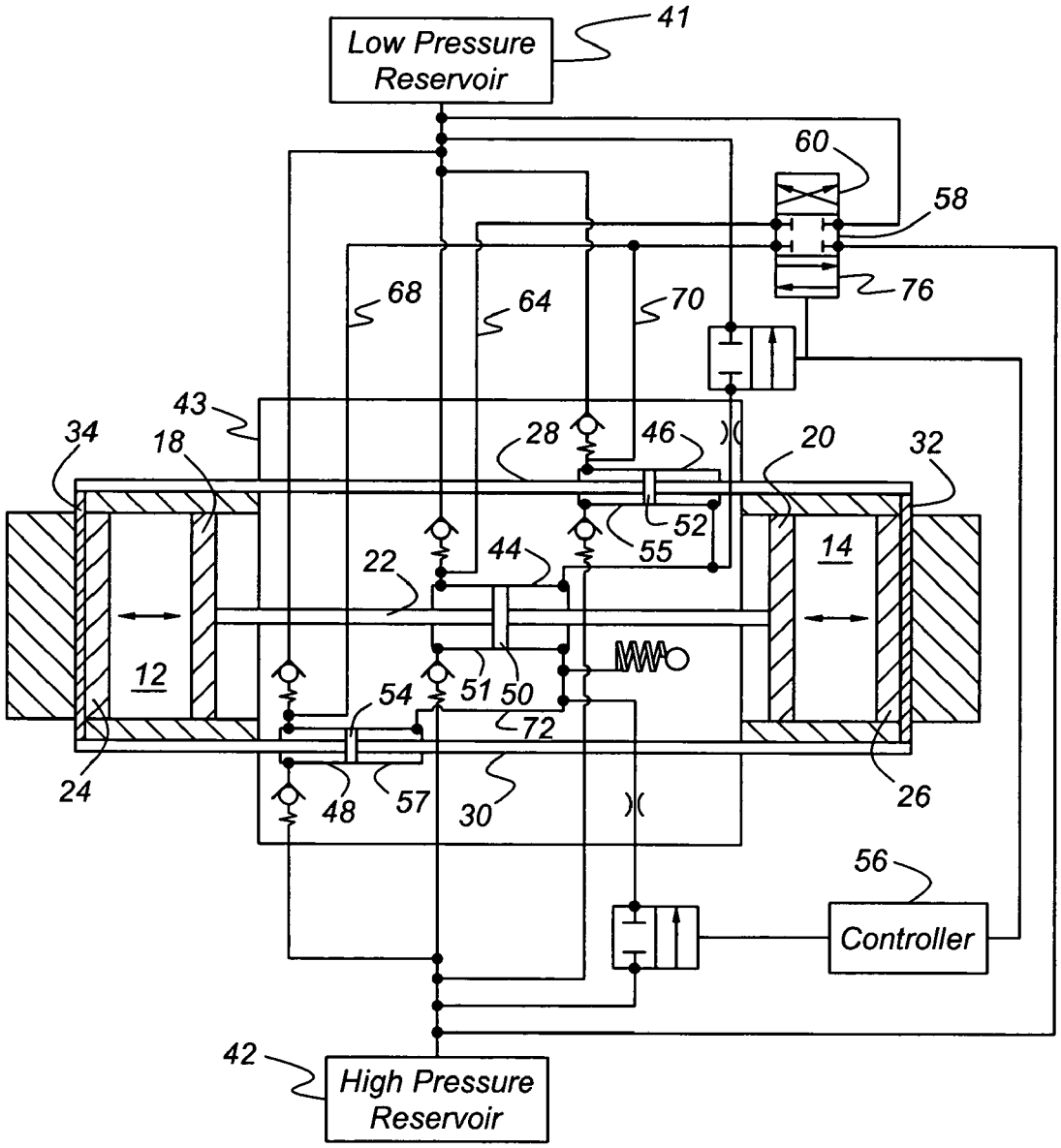
FIG. 3 is a schematic diagram of a fluid control system having a controller for operating fluid pump-motors connected to the engine piston pairs for starting the engine.

The synchronized, coordinated movement of the pistons is controlled through a hydraulic circuit, which includes fluid motor-pumps check valves and lines contained in a hydraulic or pneumatic block 43, located axially between the cylinder sleeves 16, 17. Referring next to FIG. 3, the control circuit includes a low pressure accumulator 41, a high pressure accumulator 42, a motor pump 44 driveably connected to push rod 22, a motor pump 46 driveably connected to pull rod 28, and a motor pump 48 driveably connected to pull rod 30. Push rod 22 is formed with a piston 50 located in a cylinder 51 formed in block 43. Reciprocation of engine pistons 18, 20 causes piston 50 of motor pump 44 to reciprocate. Pull rods 28, 30 are each formed with pistons 52, 54, located in cylinders 55, 57, respectively, formed in block 43. Reciprocation of engine pistons 24, 26 causes pistons 52, 54 of motor pumps 46, 48 to reciprocate.

The actuator connects high pressure accumulator 42 alternately to actuator motors 44, 46, 48 in order to displace the piston pairs 18–20, 24–26 in their respective cylinders 12, 14 against the pressure produced in the cylinders during the compression stroke. Preferably the actuator motors 44, 46, 48 apply force to the pistons when the pistons are at or near the BDC position, and the motors remove the actuating force before the piston reaches the TDC position. The pressure developed in each cylinder during its compression stroke forces the piston away from the TDC position during the expansion stroke. The increase of piston displacement for each piston displacement cycle is accomplished by progressively increasing the magnitude of the pressure applied by the actuator motors during each displacement cycle, or by increasing the length of the period when pressure is applied to the actuator, or by a combination of these actions.

When the engine 10 is running, the coordinated reciprocating movement of the engine pistons draws fluid from the low pressure accumulator 41 to the pump motors 44, 46, 48, which produce hydraulic or pneumatic output fluid flow, supplied to the high pressure accumulator 42. The motor-pumps 44, 46, 48 operate as motors driven by pressurized fluid in order to start the engine, and operate as pumps to supply fluid to the high pressure accumulator for temporary storage there or to supply fluid directly to fluid motors, which drive the wheels in rotation against a load.

An electronic controller 56 produces an actuating signal transmitted to a solenoid or a relay, which, in response to the actuating signal, changes the state of a control valve 58. For example, when the hydraulic system is operating as a motor to move the engine pistons preparatory to starting the engine, controller 56 switches valve 58 between a first state 60, at which accumulator 42 is connected through valve 58 to the left-hand side of the cylinder 51 of pump-motor 44 through line 64. With valve 58 in the state 60, the left-hand sides of the cylinders 55, 57 of motor-pumps 46, 48, are connected through lines 68, 70 and valve 58 to the low pressure accumulator 41. These actions cause piston 50 to move rightward forcing fluid from pump-motor 44 through line 72 to the right-hand side of the cylinder 57, and through line 74 to the right-hand side of cylinder 55. In this way, the first state of valve 58 causes the fluid control system to move engine pistons 18, 20 rightward and engine pistons 24, 26 to move leftward from the position shown in FIG. 3.

When controller 56 switches valve 58 to the second state 76, high pressure accumulator 42 is connected through line 68 to the left-hand side of piston 57 of motor-pump 48, and through line 70 to the left-hand side of piston 55 of motor-pump 46. This forces engine pistons 24, 26 rightward. When valve 58 is in the second state 76, the low-pressure accumulator 41 is connected through valve 58 and line 64 to the left-hand side of cylinder 51 of motor-pump 44. As pistons 52, 54 move rightward, fluid is pumped from cylinders 55, 57 through lines 74, 72, respectively, to the right-hand side of cylinder 51. This causes piston 50, push rod 22 and engine pistons 18, 20 to move leftward.

Figure 4A:
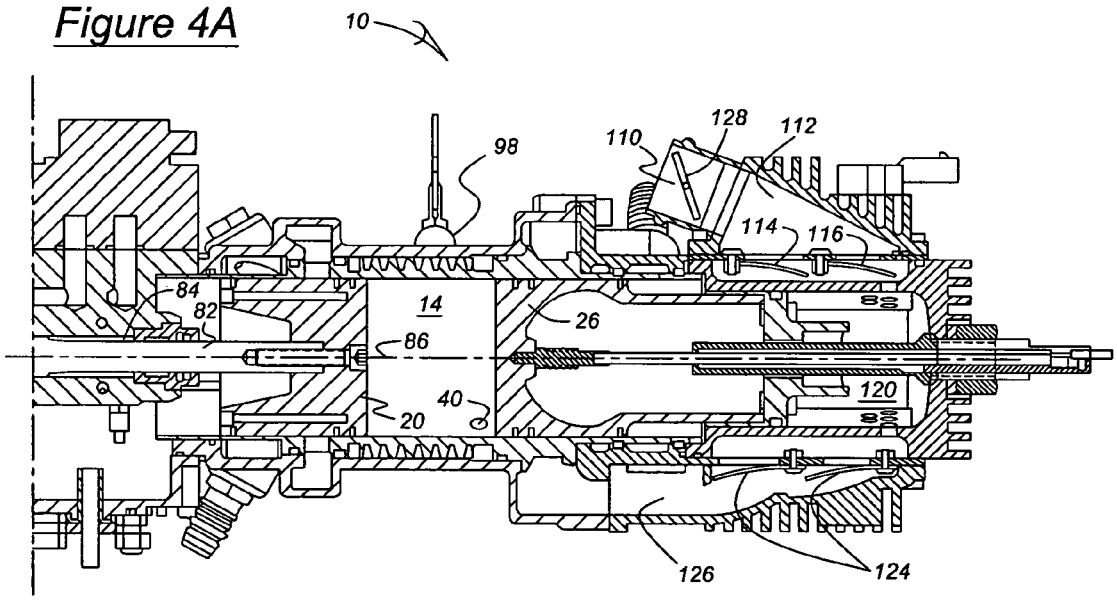
FIG. 4 is a cross section taken along a longitudinal plane of an engine and hydraulic motor-pump assembly.
Figure 4B:
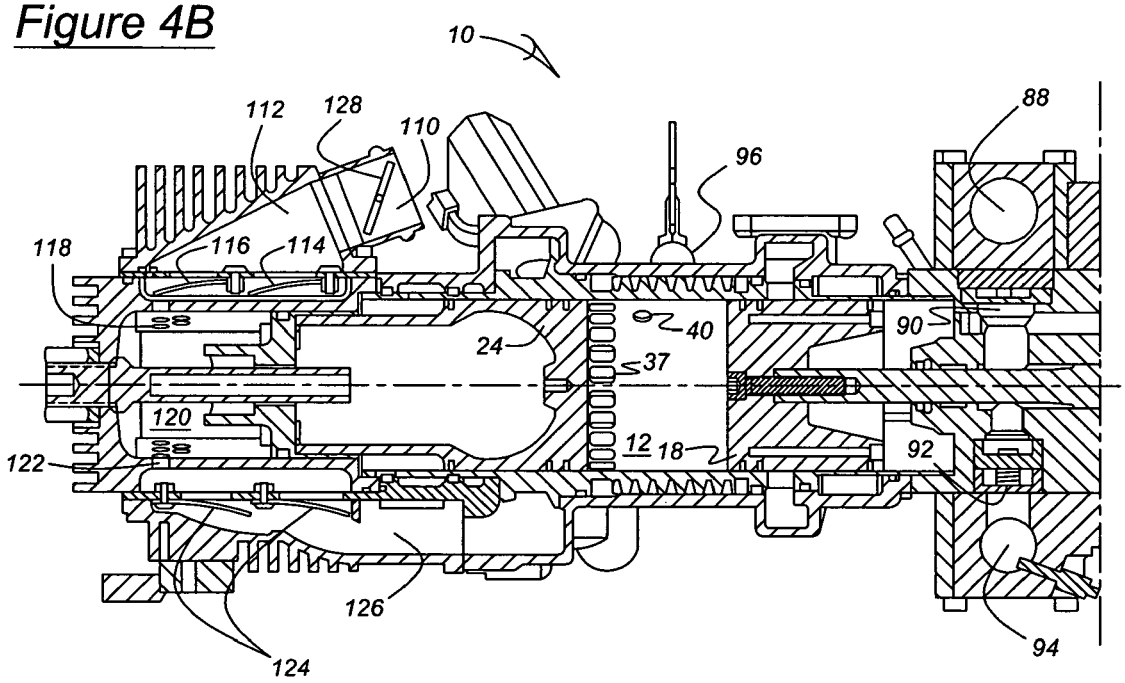

Referring now to the cross section of FIGS. 4A and 4B, the inner pistons 18, 20 are bolted to a hydraulic plunger 82, which reciprocates with pistons 18, 20 within a hydraulic cylinder 84 along axis 86. When the engine 10 is producing hydraulic output, hydraulic fluid at relatively low pressure is supplied to cylinder 84 from a low pressure rail 88 through a check valve 90, which opens communication to cylinder 84 when the pressure in rail 88 is greater than the pressure in the cylinder 84, and otherwise closes communication to prevent flow from rail 88 to the cylinder 84. Similarly, plunger 82 pumps hydraulic fluid from cylinder 84 through a check valve 92 to a high-pressure rail 94. Check valve 92 closes to prevent flow from rail 94 to cylinder 84 when pressure in rail 94 is greater than that of cylinder 84.

Pressure sensors 96, 98 produce electronic signals representing the pressure in combustion cylinders 12, 14. The signals produced by sensors 96, 98 are supplied as input to the electronic controller 56, which receives other input signals, executes control algorithms that employ information regarding current operation conditions represented by the input signals, and produces output signals for controlling engine throttle valves 128, 129, a fuel supply system, an engine ignition system, and the starter-actuator. Fuel injectors 100 supply fuel to cylinders 12, 14 through the fuel ports 40 under programmed control of controller 56.

Figure 5:
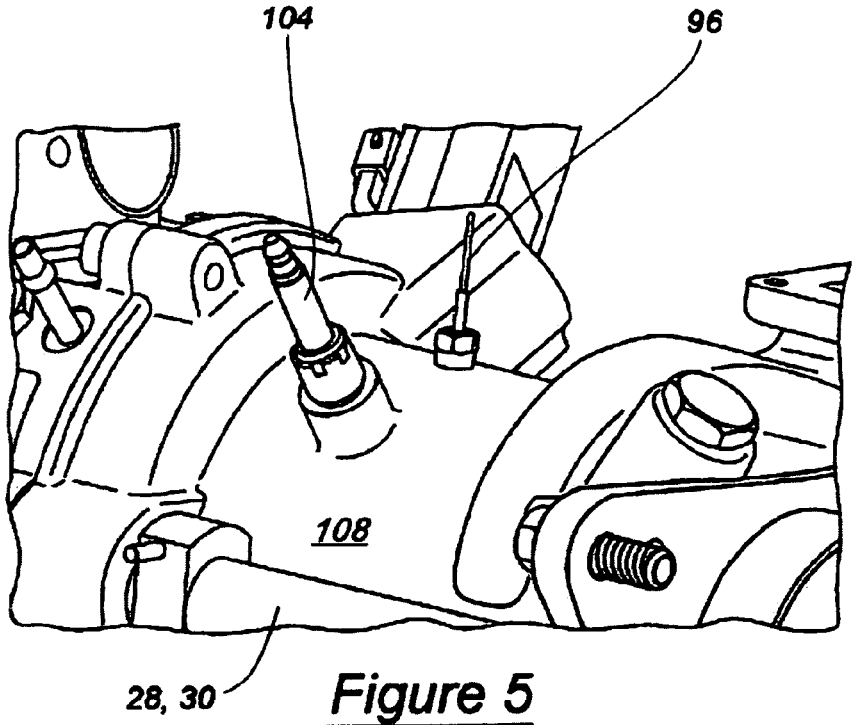
FIG. 5 is an isometric view of a portion of the outer surface of the engine of FIG. 1.
Figure 6:
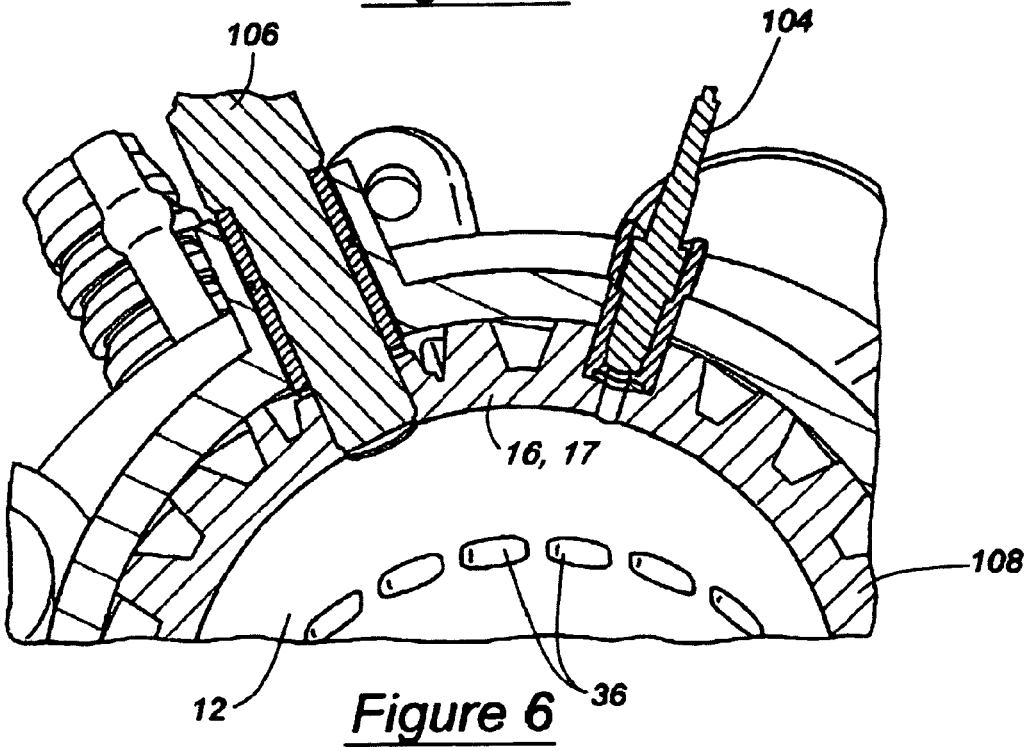
FIG. 6 is a partial transverse cross section of the engine of FIG. 1 taken at the location of a spark plug or a glow plug.

FIG. 5 shows the location of a spark plug 104, and FIG. 6 shows a glow plug 106, which can be used instead of a spark plug. Either the spark plug or glow plug is located in a wall 108 of each liner 16, 17 of combustion cylinders 12, 14. When the spark plug 104 is used, controller 56 produces an output signal that ultimately produces a voltage differential across the spark plug terminals and a spark in the combustion chamber, which ignites the air-fuel mixture there. When the glow plug 106 is used, controller 56 produces an output signal that causes an electric current momentarily to pass through the glow plug creating a hot spot in the combustion chamber that ignites the air-fuel mixture.

Air enters the engine through inlet ports 36, 37, which communicate with the output of a turbocharger (not shown). Inlet ports 37 in cylinder 12 are supplied from the turbocharger with air though passages 110, 112; intake reed valves 114, 116; scavenge pump inlet ports 118; a scavenge pump 120; scavenge pump outlet ports 122; outlet reed valves 124; and an air intake annulus 126, which communicates with inlet ports 37. A similar circuit carries air from the turbocharger output to air inlet ports 36 in cylinder 14. Passages 110 each contain a throttle valve 128, which opens and closes in response to an output command signal produced by controller 56 while starting the engine. After the engine is started, throttle valves 128 are opened, and the engine operates independently of throttle control or ignition control, preferably with homogeneous charge compression ignition.

Before fuel is injected to start the engine 10, pistons 18, 20 are moved leftward and pistons 24, 26 are moved rightward by the actuator toward the position shown in FIG. 1 sufficiently to cause the pistons to open the inlet ports 36 in cylinder 14, thereby ensuring that cylinder 14 is filled with a pneumatic charge, an air charge. Next, pistons 18, 20 are moved rightward and pistons 24, 26 are moved leftward by the actuator toward the position shown in FIG. 2 sufficiently to cause the pistons to open the inlet ports 37 in cylinder 12, thereby ensuring that cylinder 12 is filled with an air charge.

After an air charge is admitted to each cylinder, the actuator reciprocates the pistons producing compression and expansion strokes having increasing piston displacement or stroke, increasing piston speed, increasing peak pressure in the combustion chamber, increasing compression ratio of the air charge, but without allowing piston displacement to open the inlet ducts 36, 37. Cyclic compression and expansion of the air charges in cylinders 12, 14 are analogous to the effect of a compression spring located in each cylinder. Compression of the pneumatic charge in a cylinder opposes acceleration of the piston masses toward the TDC position in that cylinder. Expansion of the pneumatic charge in a cylinder assists in accelerating the piston masses toward the BDC position in that cylinder. As the charge in one cylinder is being compressed, the charge in the other cylinder is expanding. Therefore, pressure forces are continually developed that assist the pistons in each cylinder to move alternately toward the TDC and BDC positions in the correct phase relationship.

To restart a hot or warm engine, it is expected that only one or two cycles of compression and expansion strokes will be required after admitting the air charges to the cylinders and before subsequent engine starting steps are performed. To start a cold engine, it is expected that about ten such cycles will be required after admitting the air charge and before additional engine starting steps are performed.

Next, a volume of fuel to be added to each air charge during a first series of cycles while starting the engine with spark ignition is determined. Throttle valves 128 are used to establish a flow rate of air into the cylinders through the inlet ports 36, 37 during a first series of starting cycles. Fuel is admitted to the cylinders through fuel ports 40 such that a stoichiometric mixture of fuel and air, or a mixture that is approximately stoichiometric, is present in the cylinders. Either spark plug 104 or glow plug 106 produces ignition. Combustion of the fuel-air mixture in the cylinders 12, 14 at the correct phase relation to the peak pressure occurs. After the engine begins to run under spark ignition, the actuator stops driving the pistons, and the engine operates independently of the starter-actuator. The engine controller causes the fuel injectors 100, 102 to inject fuel repetitively in an appropriate quantity of fuel thorough fuel ports 40 into the combustion chambers located between the pistons in each cylinder 12, 14.

The peak pressure in each cylinder is monitored by pressure sensors 96, 98. The controller 56 determines whether the peak pressure during spark ignition occurs when the pistons are at the TDC position in the combustion cylinder, or within a predetermined period or distance after the TDC position. The period is preferably about 0.25 ms. after TDC, or a delay comparable to 2° after TDC for a two stroke, crankshaft internal combustion engine supplied with a comparable fuel, such as gasoline. The controller 56 adjusts the spark ignition timing until the peak pressure occurs within an acceptable phase range.

When ignition occurs at an acceptable phase relation to the peak pressure, a second series of engine starting cycles begins. During these engine cycles, the air-fuel ratio in the cylinders is reduced by using the throttle valves 128 to increase the air flow rate supplied to the cylinders, or by using the fuel injectors 100, 102 to reduce the fuel flow rate to the cylinders, or by using both the throttle valves and fuel injectors to increase the air flow rate and reduce the fuel flow rate. The spark ignition system is turned off by the engine controller 56. Thereafter, the engine operates preferably with a homogenous air-fuel charge and combustion occurs by compression ignition. After the engine starts and continues to run under programmed control, and an external load can be placed on the engine.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A method for starting a free piston internal combustion engine that includes a first pair of mutually connected pistons, a second pair of mutually connected pistons, a first piston of each pair moving in a first cylinder, a second piston of each pair moving in a second cylinder, the method comprising the steps of:

supplying an air charge in a space located between the pistons in each cylinder;

closing the spaces against passage of fluid while reciprocating the pistons in the cylinders and cyclically increasing a maximum pressure of the air charges in the spaces;

cyclically admitting air and fuel to the cylinders to produce an air-fuel mixture;

using spark ignition to produce cyclic combustion of the air-fuel mixture;

reducing an air-fuel ratio of the mixture when a maximum pressure in the cylinder occurs within a predetermined period following movement of a piston pair past a TDC position;

discontinuing spark ignition; and producing cyclic combustion ignition of the air-fuel mixture.

2. The method of claim 1, further comprising the steps of:

admitting fuel to the air charges to produce an air-fuel mixture in the spaces; and igniting the air-fuel mixture in the spaces by spark ignition to produce combustion of the mixture.

3. The method of claim 1, further comprising the steps of:

admitting fuel to the air charge to produce a substantially stoichiometric air-fuel mixture in the spaces; and igniting the air-fuel mixture in the spaces by spark ignition to produce combustion of the mixture.

4. The method of claim 1, wherein the step of cyclically admitting air and fuel to the cylinder and producing spark ignition of the air-fuel mixture further comprises:

cyclically producing a substantially stoichiometric air-fuel mixture in the cylinders.

5. The method of claim 1, wherein the step of reciprocating the pistons in the spaces and cyclically increasing pressure of the air charge in the spaces, further comprises:

applying a periodic force to the pistons to reciprocate the pistons in the cylinders.

6. The method of claim 1, wherein the step of reciprocating the pistons in the space and cyclically increasing a maximum pressure of the air charge in the space;

cyclically increasing pressure of the air charge to a predetermined magnitude before using spark ignition to produce cyclic combustion of the air-fuel.

7. The method of claim 1, wherein the step of reciprocating the pistons in the space and cyclically increasing pressure of the air charges, further comprises:

cyclically increasing a maximum speed of piston displacement as the piston reciprocates in the cylinder.

8. The method of claim 1, wherein the step of reciprocating the pistons and cyclically increasing pressure of the air charges, further comprises:

cyclically increasing a compression ratio of an air charge as the pistons reciprocate in the cylinder.

9. The method of claim 1, wherein the step of reducing the air-fuel ratio of the mixture further comprises:

using a throttle valve to increase a rate of air flow into the cylinders.

10. The method of claim 1, wherein the step of reducing the air-fuel ratio of the mixture further comprises:

using a throttle valve to increase a rate of air flow into the cylinder; and reducing a rate of fuel flow into the cylinders.

11. The method of claim 1, wherein the step of reducing the air-fuel ratio of the mixture further comprises:

reducing a rate of fuel flow into the cylinders.

12. The method of claim 1, wherein the step of using spark ignition to produce cyclic combustion of the air-fuel mixture further comprises using a spark plug to ignite the air-fuel mixture in the cylinders.

13. A method for starting a free piston internal combustion engine that includes a cylinder, a piston located in the cylinder for movement therein, the method comprising the steps of:

supplying an air charge to a space in the cylinder;

closing the space against passage of fluid while reciprocating the piston in the cylinder and cyclically increasing a maximum pressure of the air charge in the space;

cyclically admitting air and fuel to the cylinder to produce an air-fuel mixture in the cylinder;

using spark ignition to produce cyclic combustion of the air-fuel mixture;

reducing an air-fuel ratio of the mixture when a maximum pressure in the cylinder occurs within a predetermined period following movement of a piston past a TDC position;

discontinuing spark ignition; and producing cyclic combustion ignition of the air-fuel mixture.

14. The method of claim 13, further comprising the steps of:

admitting fuel to the air charge to produce an air-fuel mixture in the space; and igniting the air-fuel mixture in the space by spark ignition to produce combustion of the mixture.

15. The method of claim 13, further comprising the steps of:

admitting fuel to the air charge to produce a substantially stoichiometric air-fuel mixture in the space; and igniting the air-fuel mixture in the space by spark ignition to produce combustion of the mixture.

16. The method of claim 13, wherein the step of cyclically admitting air and fuel to the cylinder and producing spark ignition of the air-fuel mixture further comprises:

cyclically producing a substantially stoichiometric air-fuel mixture in the cylinder.

17. The method of claim 13, wherein the step of reciprocating the piston and cyclically increasing pressure of the air charge in the space, further comprises:

applying a periodic force to the piston to reciprocate the piston in the cylinder.

18. The method of claim 13, wherein the step of reciprocating the piston in the space and cyclically increasing a maximum pressure of the air charge in the space;

cyclically increasing pressure of the air charge to a predetermined magnitude before using spark ignition to produce cyclic combustion of the air-fuel.

19. The method of claim 13, wherein the step of reciprocating the piston and cyclically increasing pressure of the air charge in the space, further comprises:

cyclically increasing a maximum speed of piston displacement as the piston reciprocates in the cylinder.

20. The method of claim 13, wherein the step of reciprocating the piston and cyclically increasing pressure of the air charge in the space, further comprises:

cyclically increasing a compression ratio of the air charge as the piston reciprocates in the cylinder.

21. The method of claim 13, wherein the step of reducing the air-fuel ratio of the mixture further comprises:

using a throttle valve to increase a rate of air flow into the cylinder.

22. The method of claim 13, wherein the step of reducing the air-fuel ratio of the mixture further comprises:

using a throttle valve to increase a rate of air flow into the cylinder; and reducing a flow rate of fuel into the cylinder.

23. The method of claim 13, wherein the step of reducing the air-fuel ratio of the mixture further comprises:

reducing a flow rate of fuel into the cylinder.

24. The method of claim 13, wherein the step of using spark ignition to produce cyclic combustion of the air-fuel mixture further comprises using a spark plug to ignite the air-fuel mixture in the cylinder.

* * * * *